US008359979B2

(12) United States Patent
Dave et al.

(10) Patent No.: US 8,359,979 B2
(45) Date of Patent: Jan. 29, 2013

(54) COMPOSITE PROJECTILE

(75) Inventors: Vivek R. Dave, Sante Fe, NM (US); Mark J. Cola, Sante Fe, NM (US); Daniel A. Hartman, Santa Fe, NM (US); C. Robert Kline, Jr., Santa Fe, NM (US); Joel W. House, Eglin AFB, FL (US); Geremy Jason Kleiser, Niceville, FL (US)

(73) Assignee: B6 Sigma, Inc., Santa Fe, NM (US)

( * ) Notice: Subject to any disclaimer, the term of this patent is extended or adjusted under 35 U.S.C. 154(b) by 336 days.

(21) Appl. No.: 11/379,378

(22) Filed: Apr. 19, 2006

(65) Prior Publication Data

US 2007/0163460 A1 Jul. 19, 2007

Related U.S. Application Data

(60) Provisional application No. 60/766,396, filed on Jan. 17, 2006.

(51) Int. Cl.
*F42B 12/04* (2006.01)
*F42B 12/74* (2006.01)

(52) U.S. Cl. ..... 102/517; 102/364; 102/518; 86/54; 86/51

(58) Field of Classification Search ..... 102/517, 102/518, 519, 501, 364; 86/51, 54
See application file for complete search history.

(56) References Cited

U.S. PATENT DOCUMENTS

| | | | | |
|---|---|---|---|---|
| 4,112,846 | A * | 9/1978 | Gilbert et al. | 102/364 |
| 4,807,795 | A * | 2/1989 | LaRocca et al. | 228/107 |
| 4,928,368 | A * | 5/1990 | Greenspan et al. | 86/55 |
| 6,446,558 | B1 * | 9/2002 | Peker et al. | 102/306 |
| 2002/0059882 | A1 * | 5/2002 | Begg | 102/518 |
| 2005/0072498 | A1 * | 4/2005 | Begg | 148/562 |

* cited by examiner

*Primary Examiner* — James Bergin
(74) *Attorney, Agent, or Firm* — V. Gerald Grafe

(57) ABSTRACT

A projectile formed from dissimilar materials. The projectile includes a metallurgical interlayer that joins the dissimilar materials together. The metallurgical interlayer also matches the shock impedance of the two materials to prevent delamination during launch and during impact.

17 Claims, 1 Drawing Sheet

| Material | Melting Point, °C | Density, g/cc | Thermal expansion coeff., micron/meter/°C | Elastic Modulus, GPa |
|---|---|---|---|---|
| Ta | ~3000 | 16.6 | 6.5 | 186 |
| Nb | 2468 | 8.57 | 7.31 | 103 |
| Zr | 1852 | 6.49 | 5.85 | 99.3 |

Table 1: Thermophysical properties of Ta, Nb and Zr.

| Material | Melting Point, ° C | Density, g/cc | Thermal expansion coeff., micron/meter/°C | Elastic Modulus, GPa |
|---|---|---|---|---|
| Ta | ~3000 | 16.6 | 6.5 | 186 |
| Nb | 2468 | 8.57 | 7.31 | 103 |
| Zr | 1852 | 6.49 | 5.85 | 99.3 |

Table 1: Thermophysical properties of Ta, Nb and Zr.

Figure 1

| Material | Shock Impedance at u=2.5 km/s; units of (g/cc)*(km/s) |
|---|---|
| Ta | 106.5 |
| Nb | 63.9 |
| Zr | 23.7 |

Table 4: Shock Impedances of Ta, Nb and Zr at u=2.5 km/s

Figure 2

COMPOSITE PROJECTILE

RELATED APPLICATIONS

This application relates to provisional application 60/766,396 filed on Jan. 17, 2006.

FIELD OF THE INVENTION

This invention relates to the field of ammunitions rounds, projectiles and warheads having multiple properties.

BACKGROUND OF THE INVENTION

Bonding of dissimilar materials is frequently performed for a variety of reasons. Typically the dissimilar materials each have properties that are desired in a particular product. The bonding of these materials can be done successfully in many products. However, in certain products, this bonding is problematic. The bonding of dissimilar materials in products that undergo a harsh dynamic environment often fail. An example of such products are ballistic projectiles that undergo extreme environments during launch and upon impact on a target.

Weaponry systems using ammunition rounds, projectiles or warheads have been in use for centuries. These have evolved into complex systems capable of delivering their payloads at high speeds and long distances. The payloads, such as ammunition rounds, projectiles or warheads have evolved as well, from simple lead projectiles to high density warheads capable of entering hardened surfaces.

Often it is desirable for these projectiles to possess certain characteristics in order to achieve specific results. For example, certain projectiles may be formed from a hardened material such as tungsten in order to enter into hardened surfaces.

Ammunition that is capable of entering hardened surfaces with a high energy release has become required in order to combat improvements in armor as well as other applications. While certain materials are currently being used, such as tungsten, that are capable of penetrating hardened armor, these materials do not have high reactivity or fire start capability. Currently, projectiles formed of depleted uranium have been used to penetrate and destroy armored vehicles. Depleted uranium has high density and pyrophoricity (ability to burn) which makes it desirable for these high kinetic energy applications. Unfortunately, this ammunition creates an unacceptable environmental risk. Fine particulates of uranium can be inhaled which may result in illness or sensitization. Also, the spent rounds create a hazardous waste product.

There are also other applications for weapon munitions that have combinations of characteristics. Attempts have been made in the past to form projectiles from combinations of materials to provide these different characteristics. These attempts have been unsuccessful for various reasons. The process of firing the weapon systems to launch these projectiles involves shock loading conditions on launch and impact. The prior multi-material projectiles tended to delaminate during this process. Also, the combined materials are often destroyed or damaged during impact.

Thus a need exists for a projectile formed from multiple materials that have a combination of desired properties and that can withstand the rigors of the launch and impact during use.

SUMMARY OF THE INVENTION

The present invention solves these and other problems by providing projectiles formed from dissimilar materials that will not delaminate during launch or impact. The present invention can be used for many different applications involving materials that have different properties that are combined to provide projectiles or other products that have specific characteristics.

The present invention in a preferred embodiment provides dissimilar materials that are joined by a metallurgical interlayer. The metallurgical interlayer is carefully selected to join these materials securely during the bonding process.

Another feature of a preferred embodiment of the present invention uses a metallurgical interlayer that is carefully selected to match the shock impedances of the dissimilar materials. If the shock impedances of the two materials are widely disparate, then it is more likely the materials will delaminate during the launch or during impact. This embodiment carefully selects the metallurgical interlayer so that the shock impedances of the two dissimilar materials are bridged by the shock impedance of the metallurgical interlayer. This lessens the likelihood that the materials will delaminate during the shock of the launch or the impact of the projectile.

An example of a projectile manufactured under a preferred embodiment of the present invention is the use of multiple materials to create a projectile that has high density and high pyrophoricity characteristics. These types of projectiles are useful in many situations where a hardened target is required to be penetrated and then damaged by high energy release. A preferred embodiment of the present invention provides a first high density material bonded to a second high pyrophoricity material. A metallurgical interlayer joins the two materials together to minimize delamination during the launch and the impact of the projectile. The projectile is able to penetrate a hardened surface and then provide a high energy release to damage the target.

In the preferred embodiment, the metallurgical interlayer is carefully chosen not only to join the two materials but also to match or bridge the different shock impedances of the two materials. This minimizes the delamination of the two materials during the launch of the projectile and upon the impact of the projectile against the target.

The present invention may also be used to bond dissimilar materials together for other uses as well beyond the above described projectile, other types of projectiles and other uses as well.

These and other features will be evident from the ensuing detailed description of preferred embodiments and from the drawings.

BRIEF DESCRIPTION OF THE DRAWINGS

FIG. 1 is a chart of the thermo-physical properties of materials used in one embodiment of the present invention.

FIG. 2 is a chart of the shock impedance characteristics of the materials used in the embodiment of FIG. 1.

DETAILED DESCRIPTION OF PREFERRED EMBODIMENTS

The present invention provides projectiles formed from multiple materials that combine to provide desired properties and process for creating these projectiles. The term projectile herein encompasses ammunition rounds, artillery shells, missiles, warheads and any other type of launchable projectile. A preferred embodiment of this system is described herein for explanatory purposes. It is to be expressly understood that this exemplary embodiment is provided for descriptive purposes only and is not meant to unduly limit the scope of the present inventive concept. Other embodiments and uses of the present invention are included in the claimed inventions. It is to be expressly understood that other devices are contemplated for use with the present invention as well.

The present invention in a preferred embodiment utilizes multiple materials having different properties in a projectile. Previous attempts to utilize multiple materials in a projectile were unsuccessful as the dissimilar materials tend to delaminate during the harsh environment incurred during launch and during impact. The present invention provides a carefully designed metallurgical material interlayer to join these dissimilar materials. This interlayer not only bridges the material properties between two widely different metals but also matches the shock impedances between the two dissimilar materials. This matching of the shock impedances minimizes the delamination of the bonded projectile during launch and impact. This inventive process allows many different materials having different properties and characteristics to be bonded together to form projectiles having different properties.

A preferred embodiment of the present invention is described herein. This particular embodiment is intended for use in a weapon system for high density, high energy release applications. Examples of such applications include but are not limited to a part of warhead in an air to air missile, air to ground missile, anti-ballistic missile intercept system, land-based self propelled armored vehicles, naval ordnance systems, reconfigurable autonomous strike ordnance systems, air launched self-propelled or gravity systems, anti-armor ordnance systems, anti-vehicle firearms, and any other high energy release projectiles. It is to be understood that this embodiment is provided for descriptive purposes only and other materials may be bonded together under the present invention to provide projectiles with different characteristics.

These applications all require kinetic energy penetrators. Kinetic energy penetrators are able to penetrate hardened surfaces, such as armor and also have high energy release (pyrophoricity) to damage and defeat the interior of such targets. Depleted uranium which was developed by the United States and British military in the 1991 Gulf War is an example of a kinetic energy penetrator. Depleted uranium projectiles have extremely high density that enables it to penetrate armor along with pyrophoricity so the projectile burns at high temperatures without exploding. However depleted uranium has enormous long term environmental risks before, during and after use.

The preferred embodiment of the present invention provides kinetic energy penetrators without these additional risks. This preferred embodiment combines multiple materials that provide high density to enable the projectile to penetrate the target along with pyrophoricity that burns without exploding.

In this preferred embodiment, the projectile is formed from two dissimilar materials that have widely different thermo-physical properties. Previous projectiles that have been formed from multiple materials tend to delaminate upon launch or upon impact. The present invention of this preferred embodiment utilizes a first material having a high density and high refractory properties bonded to a low density material having pyrophoricity properties. This projectile is intended to be able to penetrate hardened surfaces, such as armor, without exploding upon impact, then provide a high energy release. It has been difficult to bond such materials together in the past.

The present invention provides a carefully selected third material that acts as a metallurgical interlayer. This interlayer is carefully chosen to bond to both materials so to prevent delamination between the two materials. This interlayer also matches the shock impedances of the two materials to prevent the delamination of the bonded projectile.

The projectile of a preferred embodiment uses a high density, high refractory material such as Tantalum to provide the ability to penetrate hardened surfaces. This material has primarily been used in the past for electrical components and for surgical implants. It has a high melting point and is very dense as shown in the thermo-physical properties chart of FIG. 1. It is to be expressly understood that other high density materials may be used as well.

The second material used in this projectile is a material having high pyrophoricity such as zirconium. This material is lightweight and highly flammable. It is to be expressly understood that other materials having high pyrophoricity may be used as well.

A metallurgical interlayer is carefully chosen to bond these two materials together and to match the shock impedances more closely to one another. In this particular embodiment, niobium is selected for these two materials. Niobium bonds well with both materials and closely matches the shock impedances for both materials together so that is not a widely disparate range between the two other materials as shown in the shock impedances chart of FIG. 2. It is to be expressly understood that other materials may be used as well.

These materials may be joined together, in the preferred embodiment, by welding, explosive bonding, brazing, transient liquid phase bonding, diffusion bonding and other types of metal fabrication techniques. Also, the articles may be joined by mechanical fastening, for example the reactive material could be in the form of a bolt or threaded rod, and the high density material could have threaded holes to accommodate the reactive material. Also in a bolted or mechanically fastened configuration, it is possible to use intermediate material washers to serve as impedance matching layers. One joining technique in particular that may be used to join these materials includes friction welding and specifically inertia friction welding.

These three materials are bonded together to create a projectile that has high density and high refractory properties to penetrate hardened surfaces without exploding or delaminating and then burning at a high temperature to damage the target. This type of projectile has particular applicability for use as ammunition rounds for anti-armor or sniper use, as warheads for missiles and anti-missile systems, as warheads for artillery and tanks, bombs and any other type of projectile that requires high density and high pyrophoricity characteristics.

The claimed inventions are not meant to be limit by the above descriptive embodiments. Other uses of bonded dissimilar materials are covered under the present invention as well. The present invention has particular applicability for use with any product using dissimilar materials bonded together where a metallurgical interlayer is used to bond the materials to one another as well as to match other characteristics such as but not limited to shock impedances.

What is claimed is:

1. A projectile formed of dissimilar materials, said projectile comprising:

a first material having a first density, a first pyrophoricity, and a first shock impedance value;

a second material, different from the first material, having a second density lower than the first density, a second pyrophoricity sufficient to burn without exploding, and a second shock impedance value differing from said first shock impedance value;

a metallurgical interlayer having a third shock impedance value in between said first shock impedance value and said second shock impedance value, wherein said metallurgical interlayer is disposed between said first material and said second material and bonds said first material and said second material to one another.

2. The projectile of claim 1 wherein said first material comprises tantalum; molybdenum; tungsten; an alloy containing molybdenum, tantalum, or tungsten; or combinations thereof.

3. The projectile of claim 2, wherein said second material comprises zirconium, titanium, hafnium, thorium, uranium, or a combination thereof.

4. The projective of claim 1 wherein said first material comprises molybdenum, tantalum, or tungsten.

5. The projectile of claim 1 wherein said first material comprises tantalum.

6. The projectile of claim 5, wherein said second material comprises zirconium, and wherein said metallurgical interlayer comprises niobium.

7. The projectile of claim 5, wherein said second material comprises zirconium.

8. The projectile of claim 1 wherein said first material completely encapsulates said second material.

9. The projectile of claim 1 wherein said second material comprises zirconium, titanium, hafnium, thorium, uranium, or a combination thereof.

10. The projectile of claim 1 wherein said low density, high shock impedance material includes: a solid material form.

11. The projectile of claim 1 wherein said low density, high shock impedance material includes: pressed powder billet of composition.

12. The projectile of claim 1, wherein said second material comprises zirconium.

13. The projectile of claim 1 wherein said second material comprises zirconium.

14. A projectile formed of dissimilar materials, said projectile comprising:

a tantalum portion;

a zirconium portion;

a niobium portion disposed between and bonding together said tantalum portion and said zirconium portion.

15. A projectile as in claim 14, wherein at least one of the tantalum portion, the zirconium portion, and the niobium portion comprises a solid material form.

16. A projectile as in claim 14, wherein at least one of the tantalum portion, the zirconium portion, and the niobium portion comprises a pressed powder billet.

17. A method of making a projectile, comprising:

(a) providing a tantalum portion;

(b) providing a zirconium portion;

(c) disposing a niobium portion between said tantalum portion and said zirconium portion under conditions that facilitate bonding of the portions to each other.

* * * * *